US005488536A

United States Patent [19]

Bonavia et al.

[11] Patent Number: 5,488,536

[45] Date of Patent: Jan. 30, 1996

[54] EXCITER CIRCUIT USING GATED SWITCHES

[75] Inventors: Howard V. Bonavia, Groton; Dale F. Geislinger, Norwich, both of N.Y.

[73] Assignee: Simmonds Precision Engine Systems, Inc., Akron, Ohio

[21] Appl. No.: 40,720

[22] Filed: Apr. 1, 1993

[51] Int. Cl.[6] ..... F02P 3/09

[52] U.S. Cl. ..... 361/253; 315/209 SC; 123/596

[58] Field of Search ..... 361/251, 253; 123/595–598; 315/209 CD, 209 T, 209 SC

[56] References Cited

U.S. PATENT DOCUMENTS

| | | | |
|---|---|---|---|
| 3,583,378 | 6/1971 | Pattee . | |
| 3,635,202 | 1/1972 | Issler et al. . | |
| 3,716,758 | 2/1973 | Palazzetti . | |
| 3,800,771 | 4/1974 | Mackie | 123/148 E |
| 3,849,670 | 11/1974 | Lourigan . | |
| 4,122,816 | 10/1978 | Fitzgerald et al. . | |
| 4,244,337 | 1/1981 | Asai . | |
| 4,247,880 | 1/1981 | Morio . | |
| 4,288,834 | 9/1981 | Burson | 361/256 |
| 4,366,801 | 1/1983 | Endo et al. | 123/620 |
| 4,369,758 | 1/1983 | Endo | 123/620 |
| 4,983,886 | 1/1991 | Balland | 315/209 CD |
| 5,032,969 | 7/1991 | Eggers et al. . | |
| 5,040,042 | 8/1991 | Bauer et al. | 357/38 |
| 5,049,786 | 9/1991 | Gotisar et al. | 315/209 CD |
| 5,053,913 | 10/1991 | Lozito et al. . | |
| 5,065,073 | 11/1991 | Frus | 315/209 SC |
| 5,144,400 | 9/1992 | Bauer | 357/38 |
| 5,173,570 | 12/1992 | Braun | 102/347 |
| 5,245,252 | 9/1993 | Frus et al. | 315/209 R |
| 5,346,838 | 9/1994 | Ueno | 437/7 |

FOREIGN PATENT DOCUMENTS

| | | |
|---|---|---|
| 0297584 | 1/1989 | European Pat. Off. . |
| 0589603 | 3/1994 | European Pat. Off. . |

*Primary Examiner*—A. D. Pellinen
*Assistant Examiner*—Fritz M. Fleming
*Attorney, Agent, or Firm*—Leonard L. Lewis; William E. Zitelli

[57] ABSTRACT

An exciter for an internal combustion engine igniter plug includes a charging circuit and a discharge circuit; the charging circuit being connectable to a power supply and the discharge circuit being connectable to the plug to produce sparks; the discharge circuit comprising a storage capacitor connected to the charging circuit, a gated solid state switching device connected between the capacitor and the plug, and a trigger means for gating the switching device on and off; the capacitor being discharged when the switching device is gated on and the capacitor being charged by the charging circuit after the switching device is gated off.

23 Claims, 3 Drawing Sheets

EXCITER CIRCUIT USING GATED SWITCHES

BACKGROUND OF THE INVENTION

The invention relates generally to exciter circuits for ignition systems used with internal combustion engines. More particularly, the invention relates to exciter circuits that utilize solid-state switches such as, for example, thyristors, as control devices for producing sparks.

A conventional ignition system for an internal combustion engine, such as, for example, a gas turbine aircraft engine, includes a charging circuit, a storage capacitor, a discharge circuit and at least one igniter plug located in the combustion chamber. The discharge circuit includes a switching device connected in series between the capacitor and the plug. For many years, such ignition systems have used spark gaps as the switching device to isolate the storage capacitor from the plug. When the voltage on the capacitor reaches the spark gap break over voltage, the capacitor discharges through the plug and a spark is produced.

More recently, turbine engine and aircraft manufacturers have become interested in replacing the spark gap with a solid-state switch, such as an SCR-type thyristor. This is due, in part, because an SCR typically operates longer than a spark gap tube which may exhibit electrode erosion. Also, SCR switches are produced in large volume making them less expensive than spark gaps which are individually crafted in small quantities. Furthermore, the storage capacitor's voltage at discharge remains essentially constant over the life time of the SCR switch, but can change significantly during the life of the spark gap due to electrode erosion.

However, there are also significant disadvantages to replacing a spark gap with a conventional SCR switch. One concerns the peak power produced by the spark discharge pulse. Although spark energy is about the same for the spark gap and SCR switch designs, peak spark power is severely reduced using known SCRs because these device are limited to peak discharge currents of about 1000 amps with a current transition rate (i.e. di/dt) limit of about 200 amps/μsecond. In contrast, spark gap discharge currents rise rapidly at about 1000 amps/μsecond to a peak of about 2000 amps. This produces a high peak power that causes a loud bang and sonic shock wave that emanates from the igniter tip. It is this shock wave that breaks up and disperses the fuel particles making them easier to ignite. The high peak current and current transition rates required for high peak power do not present a problem for spark gaps but are of a destructive nature for conventional SCR devices.

When a conventional SCR is gated on, initially only a very small portion of the die area around the gate electrode attachment conducts current due to a finite spreading velocity. If a fast rising current is permitted at turn on, a high current density occurs in the small conducting area of the die resulting in high switching losses. These high losses create excessive heating and are of a destructive nature to the SCR device. To allow proper current spreading of the entire die area which will permit a safe operating environment for the SCR, a saturable core inductor, often referred to as a delay reactor, must be incorporated in the circuit design. The delay reactor is connected in series with the SCR switch, and the inductance of the reactor limits the rate of rise of the current (di/dt) for a period of time while the SCR is turning on. Once the SCR is in full conduction, the delay reactor's core saturates and the inductance becomes so small that it no longer affects the circuit operation.

If too high a di/dt level is applied to a conventional SCR device, the device will eventually and gradually become leaky, and a reduction in the break over voltage will slowly occur. The rate at which these changes take place is dependent upon how high the di/dt levels are that the switching device experiences over time.

Based on testing that has been conducted by engine manufacturers on ignition systems that employ solid-state technology, ignition lightoff has been a problem and a concern. It is believed that these no lightoff conditions are caused by at least two characteristic differences. One is that the reduced peak power level is not sufficient to maintain a clear plug, thereby resulting in the absence of a spark due to contamination fouling. The second condition results in less of a shock wave being developed, as a result of the peak power reduction, which may not be sufficient for igniting the fuel particles under more severe fuel-air ratios and contaminated mixtures.

Other disadvantages result from the SCR being a regenerative type of switch. When conduction current in a regenerative switch exceeds a critical latching level it acts as a source of internal control current sufficient to maintain the switch in conduction even after the external gate control signal is removed. As conduction current increases so does the internal control current and in effect the conduction current drives and latches the device on. This regenerative action enables the SCR to conduct the high peak currents required of exciter circuits but it also creates problems when the SCR is required to turn off or block current.

Leakage current in conventional SCR devices increases significantly at high operating temperatures. When the leakage current of an off state SCR exceeds the critical leakage level, the SCR, without an external gate signal to initiate conduction, will turn on and stay on. For this reason SCR junction temperatures cannot typically be operated above 150° C. where uncontrolled turn on renders them useless. Non-regenerative semiconductor switches such as FET devices and transistors typically operate as junction temperatures of 200° C. and above.

Even when leakage current is not sufficient to turn an SCR on it can be high enough to act as a load on the exciter's charging circuitry and divert charging current away from the storage capacitor. This causes the spark rate to decrease. To maintain a constant spark rate, known exciter designs must utilize additional timing and regulating circuitry to compensate for the leakage problem. Furthermore, the charging currents for the main storage capacitor can exceed the sustaining current limits for a conventional SCR, thus tending to keep the SCR switched on (conducting) after the capacitor has discharged through the device. Because of this problem, special circuitry is required to either turn off the charging current for a short time period or to otherwise commutate the SCR devices so as to allow the devices to recover and turn completely off so as to block voltage during the succeeding charging period. The special charging interrupt circuits can prevent direct drop-in replacement of an SCR exciter for a spark gap exciter during maintenance and overhaul.

Thus, there is a need for a simple and reliable exciter, preferably using high-temperature solid-state switches, that produces high energy sparks with high peak power at a stable spark rate without switch degradation and that can be a direct replacement for conventional spark gap exciters.

SUMMARY OF THE INVENTION

In view of the aforementioned problems, the present invention provides, in a preferred embodiment, an exciter for an internal combustion engine igniter plug, the exciter comprising a charging circuit and a discharge circuit; the charging circuit being connectable to a power supply and the discharge circuit being connectable to the plug to produce sparks; the discharge circuit comprising a storage capacitor connected to the charging circuit, a gated solid state switching device connected to the capacitor and the plug, and a trigger circuit for gating the switching device on and off; the capacitor being discharged when the switching device is on and the capacitor being charged by the charging circuit when the switching device is off.

These and other aspects and advantages of the present invention will be readily understood and appreciated by those skilled in the art from the following detailed description of the preferred embodiments as the best mode contemplated for carrying out the invention, in view of the accompanying drawings.

DETAILED DESCRIPTION OF THE INVENTION

Figure 1A:
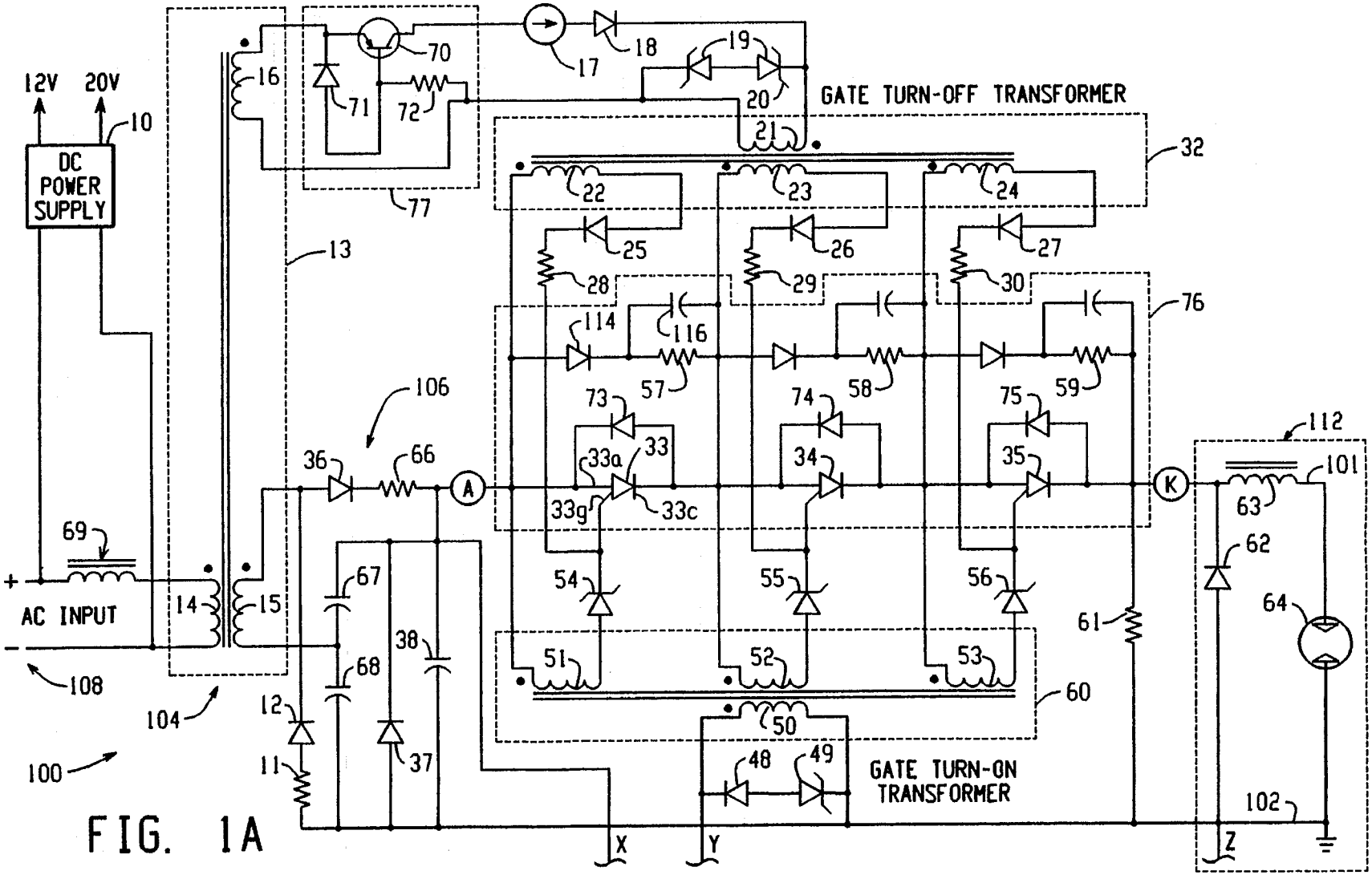
FIGS. 1A and 1B is an electrical schematic diagram illustrating a preferred embodiment of the invention for use with an internal combustion engine.

With reference to the drawings, a preferred embodiment of an exciter in accordance with the present invention is generally designated by the numeral 100. Such an exciter is particularly well suited for use in an ignition system for a gas turbine engine, such as, for example, in aircraft engines. However, exciters in accordance with the invention can also be used other than in the aircraft applications. One of the basic functions of the exciter 100 is to produce high energy sparks at the igniter plug gap; which is shown in a simplified schematic manner in the drawing and designated with the numeral 64.

The plug 64, of course, is physically positioned in the combustion chamber of the engine (not shown). The exciter 100 is connected to the plug by a high tension lead 101 and a return lead 102.

The exciter 100 includes a charging circuit 104 and a discharge circuit 106. The charging circuit is connectable, as shown, to a power supply circuit 108, such as, for example, a 115 VAC 400 Hz supply from the engine power plant. Although the invention is described herein with specific reference to the power source being an AC supply and a specific type of charging circuit, this description is only exemplary and should not be construed in a limiting sense. Those skilled in the art will readily appreciate that the invention can also be used with DC power supplies, such as for example, charging circuits that use a DC chopper to supply charging current to the main storage capacitor. Furthermore, the invention is not limited to any particular type of output circuit such as, for example, a low tension design as described herein, or augmented, high tension, oscillatory, unipolar or positive or negative designs. The invention is also not limited to use with any particular type of igniter plug.

The charging circuit 104 includes a high voltage step-up transformer 13 which includes a primary winding 14, a secondary winding 15 and a tertiary winding 16. The tertiary winding 16 is series connected through the emitter collector junction of PNP transistor 70, through current regulator 17, through diode 18, and through the primary winding 21 of gate turn off transformer 32. Diode 71 is connected inverse parallel across the emitter base junction of transistor 70 and resistor 72 is connected between the base of transistor 70 and the undotted end of winding 16. Transistor 70, diode 71, and resistor 72 comprise a synchronous rectifier assembly 77 that conducts current leaving the dotted end of winding 16 when the winding voltage is positive at this end and blocks current in this same direction when the winding voltage is negative at this end. The current regulator may be a conventional device such as part number 1N5313 available from Motorola. The regulator limits to a constant value the current supplied to the primary winding 21 by the winding 16 independent of the voltage across the winding 16.

A pair of voltage regulating zener diodes 19,20 are provided in parallel with the primary winding 21 of the gate turn-off transformer.

The charging circuit 104 further includes a full-wave voltage doubler circuit comprising rectifying diodes 12 and 36, main energy storage capacitor 38, and capacitors 67 and 68, all configured as shown in a conventional manner. Diode 37 is connected across energy storage capacitor 38 and protects switching devices 33–35 from reverse voltage whenever the output circuit 112 is configured to provide unipolar current to the igniter plug 64. The main storage capacitor is, of course, used to store energy needed to initiate a spark sequence. For example, in a low tension application such as is represented in the drawing, the storage capacitor 38 is charged to about 3000 VDC. During each charging cycle, the switching devices 33–35 are not conducting.

Figure 1B:
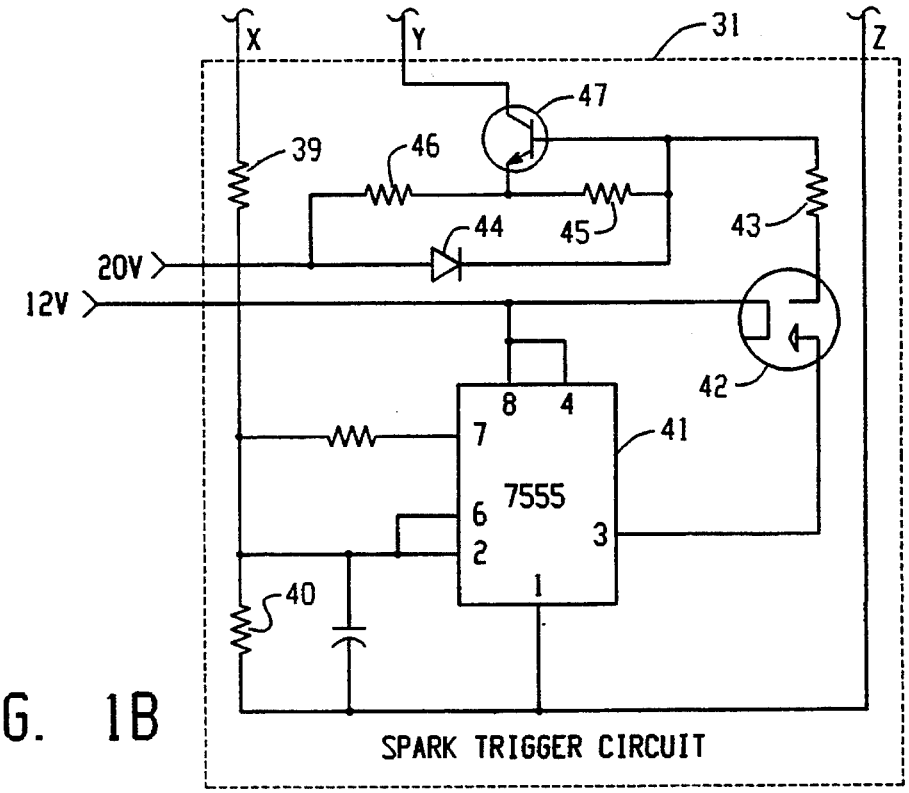

The discharge circuit 106 generally includes a spark trigger circuit 31 (circuit 31 is illustrated in FIG. 1B with the letters "X" and "Y" designating the circuit continuity between FIGS. 1A and 1B), the gate turn-off transformer 32 and associated circuitry, a switch assembly 76 which preferably includes the switching devices 33–35 and associated circuitry, and a gate turn-on transformer 60 and associated circuitry. The switching devices 33–35 are preferably series connected anode to cathode as represented in the drawing. The switches 33–35 are connected so as to isolate the storage capacitor 38 when the switches are off, and to short circuit or connect the storage capacitor across the plug 64 when the switches are on. The switches are triggered simultaneously so that the voltage across the capacitor 38 is rapidly applied across the plug electrodes. In the embodiment shown in the drawing, a unidirectional low tension exciter typically includes an output circuit 112 which includes the plug 64, an inductor 63 and a free wheeling diode 62. This type of output circuit is well known and results in a non-oscillatory unipolar current through the plug. An oscillatory design, however, could alternatively be used. Such a design would be realized by removing the free wheeling diode 62 and the storage capacitor shunt diode 37.

Thus, the switching devices 33–35 basically connect the storage capacitor 38 to the output circuit 112. The invention, however, can be used with many different types of output circuits including but not limited to output circuits that use voltage step-up transformers, current multipliers, saturable core inductors, and different types of plugs such as air gap, semiconductor and so forth. Those skilled in the art will also readily appreciate that the invention can also conveniently be used in different switch assembly topologies or configurations. For example, if capacitor 38 is negatively charged the polarity of switch assembly 76 would be reversed by connecting terminal K to capacitor 38 and terminal A to output circuit 112. The polarities of freewheeling diode 62 and storage capacitor bypass diode 37 would also be reversed. As another example, the storage capacitor 38 along with its shunt diode 37 could be juxtaposed with the switch assembly 76 from the configuration shown in the drawing. Of course polarity of the switch assembly 76, the shunt diode 37 and the freewheeling diode 62 would depend on the direction in which the storage capacitor 38 is charged. Many other configurations can be used. It will further be appreciated that the use of several switching devices is a matter of design choice based in part on the type of plug used and the stored voltage level on the capacitor 38. Each switch 33–35 can safely block about 1000 VDC, so that if 3000 VDC is needed to produce a spark then three devices are used. More or fewer switching devices can be used depending on the particular application.

The discharge circuit 106 also typically includes a resistor 61 that permits the main capacitor 38 to discharge or bleed-off if the plug fails to spark, such as might happen if the plug becomes fouled or if the pressure becomes too high.

In accordance with an important aspect of the present invention, the switching devices are preferably a type of thyristor referred to as an MCT or MOS-CONTROLLED-THYRISTOR available from Harris semiconductor under part number MCT 65P100. An MCT functions as a gate controlled switch that includes a pair of integrated MOS-FETs, one of which is used to turn the MCT device on and the other is used to turn the device off. The gate drive circuitry requires gate voltages of opposite polarity needed for the turn-on and turn-off functions. MCTs are designed with specific applications in mind and thus are available with the gate referenced to the anode for the on/off function or with the gate referenced to the cathode for the on/off function. Either type device can be used with the present invention, with the former being described in this embodiment in an exemplary manner.

Under comparable operating environments, MCT devices exhibit lower leakage currents than conventional SCR devices. This results in reduced power dissipation and heat loss within the device, affording the opportunity for higher temperature operation. We have discovered that the MCT low leakage characteristics allow an exciter to be designed that does not require the complicated timing circuits needed for conventional SCRs. The exciter circuit as described herein, for example, can be operated in a continuous charging mode, where the spark rate is simply determined by the charging rate of the capacitor as a function of the charging current from the charging circuit. The low leakage of the MCTs contributes to maintaining an acceptable spark rate over a wide temperature range without the need for special spark rate timing circuits. Also MCT devices operate at higher junction temperatures than do SCR devices (typically 200° C. versus 150° C.) because when gated off with a voltage of the proper polarity they cannot be turned on by a critical level of leakage current as can SCR devices. When gated on an MCT operates as a regenerative switch and possesses the superior current carrying capability of such a device. But with an off gate voltage applied to the MCT, regenerative action is prevented and the switch will not turn on as a result of leakage current increasing with temperature. The forcible turn-off feature also obviates the need for special commutation circuits or charging circuit interrupters. MCT devices are capable of high di/dt rates in excess of 2000 Amps/μsec without failing. This high di/dt capability enables a high peak power to be present at the igniter plug as is presently available using a conventional spark gap device. This represents a substantial improvement in performance over conventional SCR thyristors.

Again referring to the drawing, each MCT switch 33–35 includes an anode (a), cathode (c) and gate(g). These terminals are labeled for device 33 only. Each gate is connected as illustrated to the gate turn-on transformer and circuitry, as well as the gate turn-off transformer and circuitry. All three switching devices 33–35 are connected in a similar manner, therefore, only the configuration of device 33 will be described herein.

The gate turn-off transformer includes three secondary windings 22–24. The winding 22 is connected at one end through a blocking diode 25 and a resistor 28 to the gate terminal 33*g*. The other end of the secondary winding 22 is connected to the switch anode 33*a* and one end of a secondary winding 51 of the gate turn-on transformer 60. The gate 33*g* is also connected through a zener diode 54 to the other end of the secondary winding 51 of the turn-on transformer.

Each switching device segment further includes a DC balancing resistor (57–59) so that each MCT blocks a DC voltage within the manufacturer's specification. Also included for each switch is a snubber circuit including a blocking diode 114 and a capacitor 116. The snubber circuits are used in a conventional manner to compensate for possible variations in the turn-on times between the series connected switching devices. Also included are diodes 73–75 connected inverse parallel to switch devices 33–35. When the output circuit 112 is configured to provide oscillatory current to the igniter plug 64 the inverse-parallel diodes 73–75 conduct the negative half cycles of the current oscillation around the MCT devices 33–35 which are not able to conduct current in their reverse direction. The diodes 73–75 can be omitted for unipolar discharge current designs.

The spark trigger circuit 31 includes a one-shot timer 41 having a pulse-type output at pin 3 connected to a FET switch 42. The timing input (pins 2 and 6) to the timer 41 is connected through a resistor 39 to the positive electrode of the charging capacitor 38. With pin 3 of the timer 41 normally high, the FET switch 42 is normally biased off by a +12 volt DC supply, and the output of the switch is connected to a PNP transistor switch 47 through a resistor 43. With FET switch 42 normally off, the PNP transistor 47 is normally biased off by a +20 VDC supply applied via diode 44 and resistors 45 and 46 as shown. The +12 VDC and +20 VDC supplies can be obtained from the DC regulator 10, which operates from the main AC power input as described hereinbefore.

Operation of the exciter circuit illustrated in the drawing will next be described. For ease and clarity of explanation, the description will assume an initial state in which the switches 33–35 are off, the plug is not conducting current, and the AC input power supply 108 is connected to the circuit.

With the application of AC power, current flows through the inductor 69 and the primary winding of the voltage step-up transformer 13. The primary current induces a voltage in secondary winding 15 and tertiary winding 16 that is positive at the dotted ends during each half cycle when the primary is positive (as referenced for convenience as either a positive or negative half cycle of operation when current respectively flows out of the positive or negative terminal of the AC supply 108), and negative at the dotted ends during each half cycle when the primary winding is negative. During positive half cycles the voltage induced across winding 16 causes current to flow from the dotted end through the emitter base junction of PNP transistor 70 and resistor 72 back to the undotted end of winding 16 which causes the emitter collector junction of transistor 70 to conduct. This allows additional current to flow from the dotted end of winding 16 through the emitter collector junction of transistor 70, through current regulator 17, through diode 18, and through the primary winding 21 of gate turn off transformer 32 back to the undotted end of winding 16. There is no current flow in the secondary windings 22–24 because of operation of the blocking diodes 25–27.

During the same positive half-cycles of the primary winding 14, a high voltage appears across the secondary winding 15, which causes a current to flow through rectifying diode 36 and resistor 66, thereby charging main storage capacitor 38 and the doubler capacitors 67 and 68. The charge level on the capacitor 38 is monitored by the trigger circuit 31 by means of the one-shot timer 41, which includes an internal comparator.

During each negative half cycle of AC input current 108, the dotted end of winding 16 is negative therefore current flows from the undotted end through resistor 72 and diode 71 back to the dotted end of winding 16 which reverse biases the base emitter junction of PNP transistor 70 causing its emitter collector junction to turn off. This forces current developed in primary winding 21 of the gate turnoff transformer 32 during the previous half cycle to circulate through zener diodes 19–20 rather than through winding 16, the emitter collector junction of transistor 70, current regulator 17 and diode 18 which would have been the preferred path when energy storage capacitor 38 is discharged and voltage across winding 16 is less than the voltage across zener diodes 19–20. In this way voltage developed across the primary winding 21 is regulated to the zener voltage of diode 19 plus the forward drop of the second zener diode 20. This voltage may be for example 10 volts even if the voltage across winding 16 drops as low as two volts. As circulating current through primary winding 21 decays it induces a voltage reversal in the winding and in secondary windings 22–24. These secondary voltages cause current to flow from the undotted ends of secondary windings 22–24 through diodes 25–27, resistors 28–30, into the gate anode capacitance of MCT devices 33–35 and back to the dotted ends of secondary windings 22–24. By this operation, the gate capacitance of each respective internal MOSFET in the MCTs is charged, thereby forcing the gate of the MCT to a potential higher than the corresponding anode, which action forces each MCT to remain in an off condition while the main capacitor is being charged.

Also during each of the negative half-cycles of the AC input supply, voltage is induced across the secondary winding 15 of the step-up transformer 13, which causes current to flow from the secondary winding 15, through the parallel branches of the capacitor 68 and the series capacitors 67 and 38, through the resistor 11 and the other rectifying diode 12 back to the winding 15. This causes further charging of the main storage capacitor 38 to a voltage approximately double the voltage across the secondary winding 15.

Through repeated half-cycles of the AC charging supply, the MCT devices are forced to remain in a non-conducting state, while the main capacitor 38 charges.

In normal operation, as the voltage across the main capacitor 38 increases, it eventually reaches the threshold level detected by the internal comparator of the timer 41. The reference voltage for the timer 41 is internally set as a function of the supply voltage provided to input pins 4 and 8. The resistors 39 and 40 function as a resistor divider network to establish the appropriate voltage sensed from the charging capacitor 38. When the threshold level is reached, which corresponds to a sufficient charge on the capacitor 38 to break over the plug and produce a spark, the timer 41 produces a negative going pulse at the output pin 3 to the FET switch 42. This pulse may be, for example, a 30 μsec. pulse. This pulse forces the FET into conduction, which in turn causes the PNP switch 47 to turn on. When the PNP switch pulses on, current through the primary winding 50 of the turn-on transformer 60 induces a voltage across the secondary windings 51–53 that is positive at the dotted ends. This voltage causes current to flow from the dotted ends of windings 51–53 into the anode-to-gate capacitance of MCT devices 33–35, through the cathode-anode junctions of zener diodes 54–56, and back to the undotted ends of windings 51–53. This places a negative gate-to-anode potential across each of the MCT devices, thereby forcing each of the three switches into conduction near simultaneously. This initiates the discharge cycle or portion of operation of the exciter circuit.

When the MCT switches turn on, the main storage capacitor 38 discharges through the output circuit 112 and plug 64 in a conventional manner, except that the MCT devices can accommodate the high current surges that are usually destructive to a conventional SCR. As the capacitor 38 discharges, energy is transferred to the series inductor 63. When the capacitor discharge current reaches its maximum value, the polarity of the voltage across the inductor 63 reverses, and drives the spark current through the plug and the free wheeling diode 62, so that current basically no longer flows through the MCT devices.

The actual current flow through the switches 33–35 typically lasts for less than 20 μsec. When the 30 μsec. pulse across the primary of the transformer 60 terminates, a voltage reversal takes place that causes a voltage to appear across each of the secondary windings 51–53. This voltage is opposite in polarity to the voltage that turned on the switches 33–35, and causes a current to flow from the undotted ends of each of the secondary windings 51–53, through the anode-cathode junctions of zener diodes 54–56, into the gate-to-anode capacitance of each of the MCT devices 33–35 and back to the dotted ends of the secondary windings. This process thus charges the gate capacitance of the MCT devices positive with respect to the anode thereby forcing them to turn off. Thus, it will be noted that the turn-on transformer 60, in addition to turning the switches 33–35 on, also produces the initial pulse to turn the switching devices off; and the turn-off transformer produces periodic pulses that keep the devices off during the charging cycles. Of course, in the event that the 30 μsec. pulse fails to turn the switches off, the pulses from the turn-off transformer 32 will turn off the switches 33–35 on the next AC cycle.

The invention thus provides an exciter circuit that is simple in design and can provide for a constant spark rate even at higher operating temperatures, with peak power out of the exciter comparable to conventional spark gap designs. The spark rate can be maintained without the use of special timing and commutation circuits.

While the invention has been described with respect to an AC input constant current charging circuit used to achieve a constant spark rate, those skilled in the art will readily appreciate that the invention can alternatively be used conveniently with DC input invertor charging circuits, and that spark rate control, constant or otherwise, need not be limited to the control of continuous charging current or continuous charging power. For instance, control of spark rate can be achieved through duty cycle control of the charging circuit during the period between sparks using either an off/on or on/off method. Both methods of duty cycle control are similar in that the charging circuit is enabled for an interval Ton, less than the spark period $T_T$, during which time it completes the charging of the storage capacitor, and that for another interval Toff the charging circuit is disabled or otherwise prevented from charging the capacitor. The interval Toff is controlled such that Toff+Ton=$T_T$.

In the off/on method, the Toff interval immediately follows the spark and is in turn followed by the Ton interval. The capacitor is discharged at the end of the Ton interval immediately after reaching full charge. In the on/off method the Ton interval immediately follows the spark followed in turn by the Toff interval. The capacitor is maintained at full charge during the Toff interval and is discharged at the end of this interval.

Also it can be appreciated that discharge energy is dependant on storage capacitor voltage at the time of discharge and that this invention can be used with a spark trigger circuit that allows discharge voltage and energy to be controlled by one or more external signal inputs that changes either or both the voltage divider ratio or the reference level of the comparator internal to the spark trigger circuit.

Figure 2A:
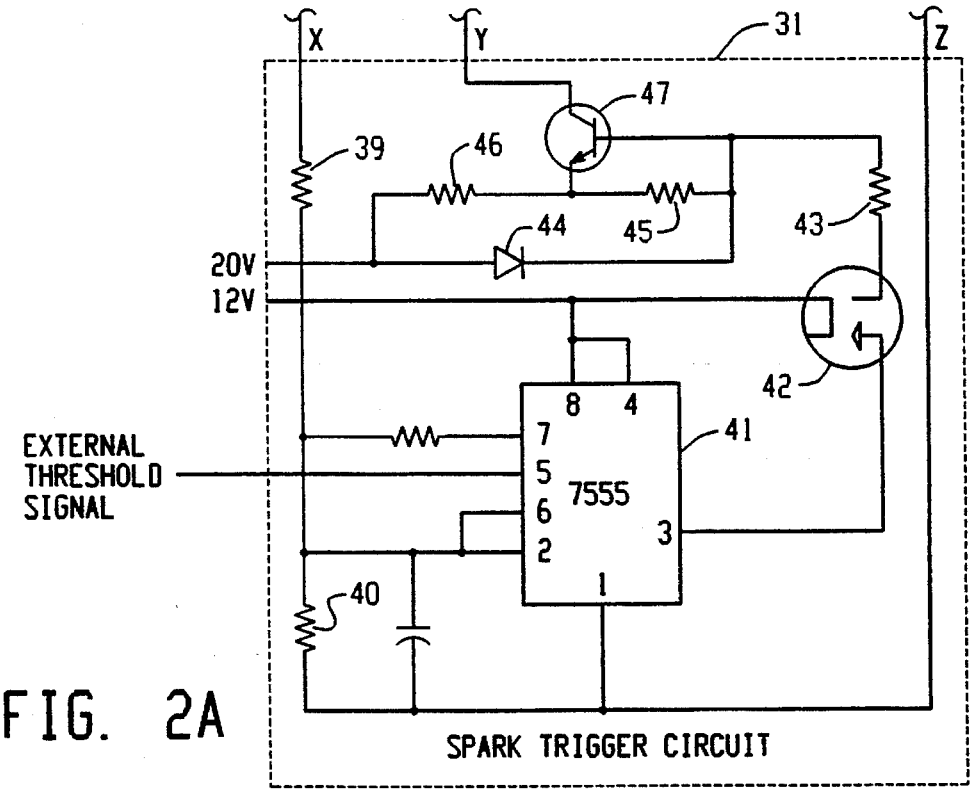
FIGS. 2A and 2B illustrate alternative trigger circuits that can be used with the invention.
Figure 2B:
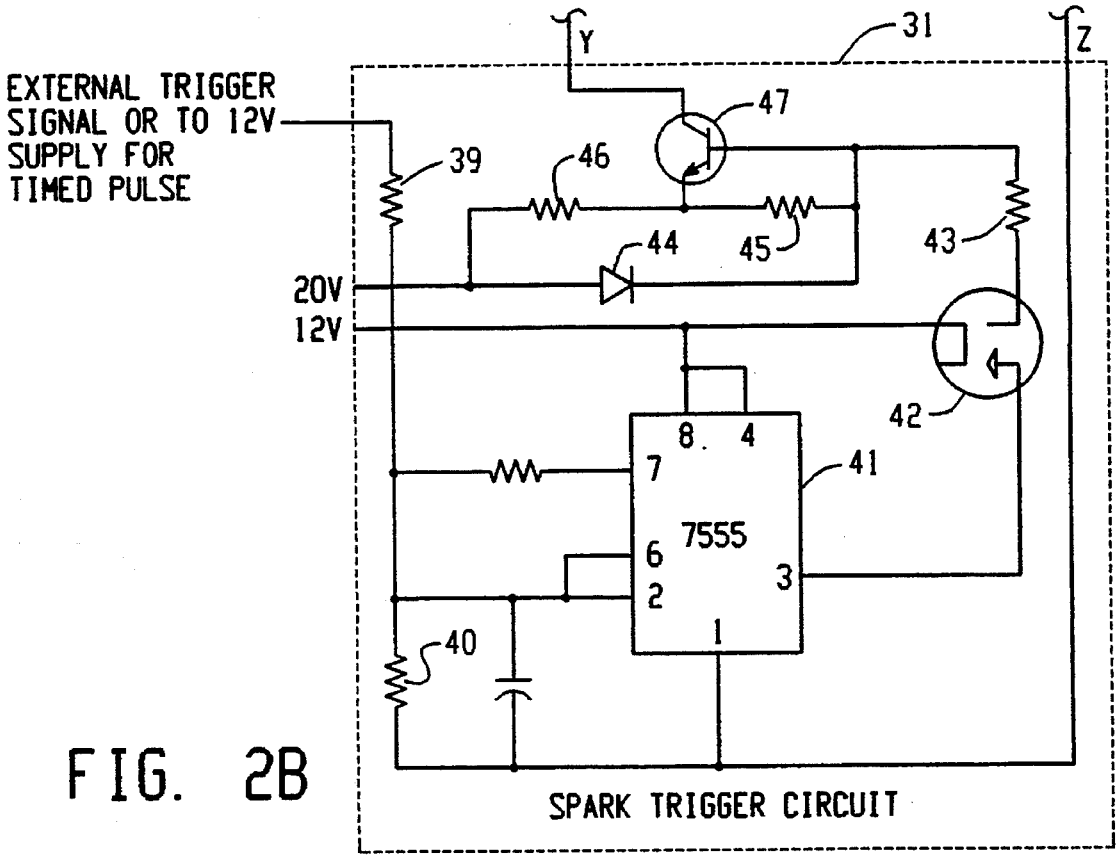

Also the invention has been described wherein the MCT devices are first turned on for a preset time and then off again by the spark trigger circuit in response to the storage capacitor voltage reaching a predetermined level. It can be appreciated that different methods of spark rate control such as the duty cycle methods previously described, different methods of spark energy control, some methods to disable the spark, and some ignition system health monitoring circuits may require the MCT devices in this invention to be controlled on and off by a different set of events and timing regimes and in order to provide the MCT devices with the proper on and or off gate signals the spark trigger circuit may be required to respond to one or more external control signals in addition to or instead of the storage capacitor voltage. Such alternative controls for the spark trigger circuit 31 are shown, for example, in FIGS. 2A and 2B wherein like numerals are used to designate components that correspond to the components of FIG. 1B. For example, in FIG. 2A, the trigger circuit 31 receives an external threshold signal input that can be used to selectively vary the threshold for the comparator device 41, thus providing a variable level of capacitor 38 charge that triggers the switches to turn on. In FIG. 2B, the comparator 41 is not connected to the capacitor 48 (i.e. it does not sense the charge level of the main capacitor). Rather, the device 41 receives an external trigger signal that causes the device 41 to turn the switches on. Alternatively, as shown in FIG. 2B, the device 41 could simply receive a constant input voltage which, in combination with resistor 40 and its associated timing capacitor, produces a predetermined timing pulse for triggering the circuit 31. Other trigger circuit timing schemes, of course, can easily and conveniently be used with the invention. When a DC charging source, such as a DC chopper, is used the DC supply may be momentarily interrupted during the discharge cycle to avoid excessive loads on the charging circuit. This interrupt can be easily effected by the use of a pulse transformer that detects the discharge cycle and feeds a control pulse back to a disable latch on the primary side of the power transformer.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

We claim:

1. An exciter for an internal combustion engine igniter plug, said exciter comprising a charging circuit and a discharge circuit; said charging circuit being connectable to a power supply and said discharge circuit being connectable to the plug to produce sparks; said discharge circuit comprising a storage capacitor connected to said charging circuit, a gate controlled and regenerative solid state switching device coupled to said capacitor and the plug, and a trigger means for gating said switching device on by a first gate signal to control discharging the capacitor and off by a second gate signal to control charging of the capacitor.

2. The exciter circuit of claim 1 wherein said switching device comprises one or more MCT thyristor device.

3. The exciter circuit of claim 1 wherein said trigger means gates said switching device on in response to said storage capacitor charge level.

4. The exciter circuit of claim 3 wherein, after said switching device is gated on, said trigger means gates said switching device off after a time delay adequate to permit said storage capacitor to discharge.

5. The exciter circuit of claim 1 wherein said switching device is an MCT thyristor having a gate, anode and cathode; said trigger means applying a first voltage potential between said gate and one of said anode and cathode to turn said thyristor off, and applying a second voltage potential between said gate and said one anode and cathode to turn said thyristor on; said first and second potentials being of opposite polarity.

6. The exciter circuit of claim 5 wherein said trigger means comprises means for periodically applying said first voltage potential with respect to said one of said anode and cathode to keep said switching device off until said storage capacitor is fully charged.

7. In combination with an exciter for an internal combustion engine wherein the exciter comprises a charging circuit, a discharge circuit and a storage capacitor connected to the charging circuit and an igniter plug to produce sparks: a gate controlled thyristor having an anode and cathode connected as a switch to the storage capacitor and the plug, and trigger means for applying a first gate signal to switch said thyristor on to control discharge of the capacitor, and for applying a second gate signal to switch said thyristor off to control charging of the capacitor.

8. The combination of claim 7 wherein said trigger means comprises means for repeatedly applying said second gate signal to keep said thyristor off while the capacitor is charging.

9. The combination of claim 7 wherein said trigger means periodically triggers said thyristor off with said second gate signal during a charging cycle of the capacitor.

10. The combination of claim 9 wherein said trigger means periodically triggers said thyristor off with said second gate signal during a charging cycle at a rate dependent on the charging current for the capacitor.

11. The combination of claim 7 wherein said trigger means operates dependent on the charge level of the capacitor.

12. The combination of claim 11, said trigger means comprising means for applying said first gate signal as a turn-on pulse to the gate of said thyristor to initiate a discharge cycle, and means for applying said second gate signal as periodic turn-off pulses to keep said thyristor off during a charging cycle.

13. The combination of claim 12 wherein said periodic turn off pulses apply a gate potential to said thyristor that is a function of charging current produced by said charging circuit.

14. The combination of claim 13 wherein said turn-on pulse means comprises a transformer that receives a timing pulse, said transformer responding to said pulse to initiate a discharge cycle and, at the end of said pulse, causing said thyristor to turn off.

15. The combination of claim 14 wherein said periodic turn off pulses means comprises a second transformer that produces pulses dependent on a charging circuit operating frequency.

16. The combination of claim 11 further comprising means for varying a threshold level used with said trigger means for detecting charge level of the capacitor.

17. The combination of claim 16 wherein said varying means comprises a control signal input to the exciter circuit.

18. The combination of claim 7 wherein said charging circuit operates from an AC supply directly.

19. The combination of claim 7 wherein said charging circuit operates from a DC supply.

20. The combination of claim 7 wherein said discharge circuit produces a unipolar discharge current.

21. The combination of claim 7 wherein said discharge circuit produces an oscillatory discharge current.

22. The combination of claim 7 wherein said trigger means responds to an external trigger signal input to the exciter.

23. The combination of claim 7 wherein said trigger means produces said gate signals at a predetermined rate independent of charge level of the capacitor.

* * * * *